US006409039B2

(12) United States Patent
Jessup

(10) Patent No.: US 6,409,039 B2
(45) Date of Patent: Jun. 25, 2002

(54) METAL FINISHING BARREL COVER LOCKING SYSTEM

(75) Inventor: Richard J. Jessup, Bloomfield Hills, MI (US)

(73) Assignee: Jessup Engineering, Inc., Rochester Hills, MI (US)

( * ) Notice: Subject to any disclaimer, the term of this patent is extended or adjusted under 35 U.S.C. 154(b) by 0 days.

(21) Appl. No.: 09/813,649

(22) Filed: Mar. 21, 2001

Related U.S. Application Data

(60) Provisional application No. 60/193,189, filed on Mar. 30, 2000.

(51) Int. Cl.[7] ..... B65D 43/12

(52) U.S. Cl. ..... 220/345.3; 204/213; 220/4.04; 220/345.4; 220/351

(58) Field of Search ..... 220/345.1–345.4, 220/351, 324, 326, 243, 246, 250, 251; 204/213

(56) References Cited

U.S. PATENT DOCUMENTS 912,041 A * 2/1909 Snow ..... 220/326
1,564,472 A * 12/1925 Daly et al. ..... 220/345.1
3,256,170 A * 6/1966 Neilson ..... 204/213
3,560,036 A * 2/1971 Kiefer et al. ..... 204/213
4,467,940 A * 8/1984 Little ..... 220/345.1

* cited by examiner

*Primary Examiner*—Allan N. Shoap
*Assistant Examiner*—Joseph C. Merek
(74) *Attorney, Agent, or Firm*—John R. Benefiel

(57) ABSTRACT

A metal finishing barrel side opening has a cover secured by a series of cover and barrel tabs, the cover slid into a secured position with the cover tabs partially overlain by the barrel tabs. A locking handle assembly includes a graspable portion supported on a deflectable spring blade attached to the cover at one end which allows the handle assembly to move away from an aligned locator feature on the barrel as the cover is pushed into position. When the cover is shifted lengthwise, the handle assembly moves past the locking feature, and the locking blade pushes the handle assembly back down alongside the locking feature which then prevents reverse sliding of the cover back from under the barrel tabs. When the handle is pulled to initiate removal of the cover, the handle assembly is then moved out above the locking feature to enable the cover to be slid to the released position. An automation apparatus interacts with one form of the locking assembly to automatically install and remove the cover.

9 Claims, 11 Drawing Sheets

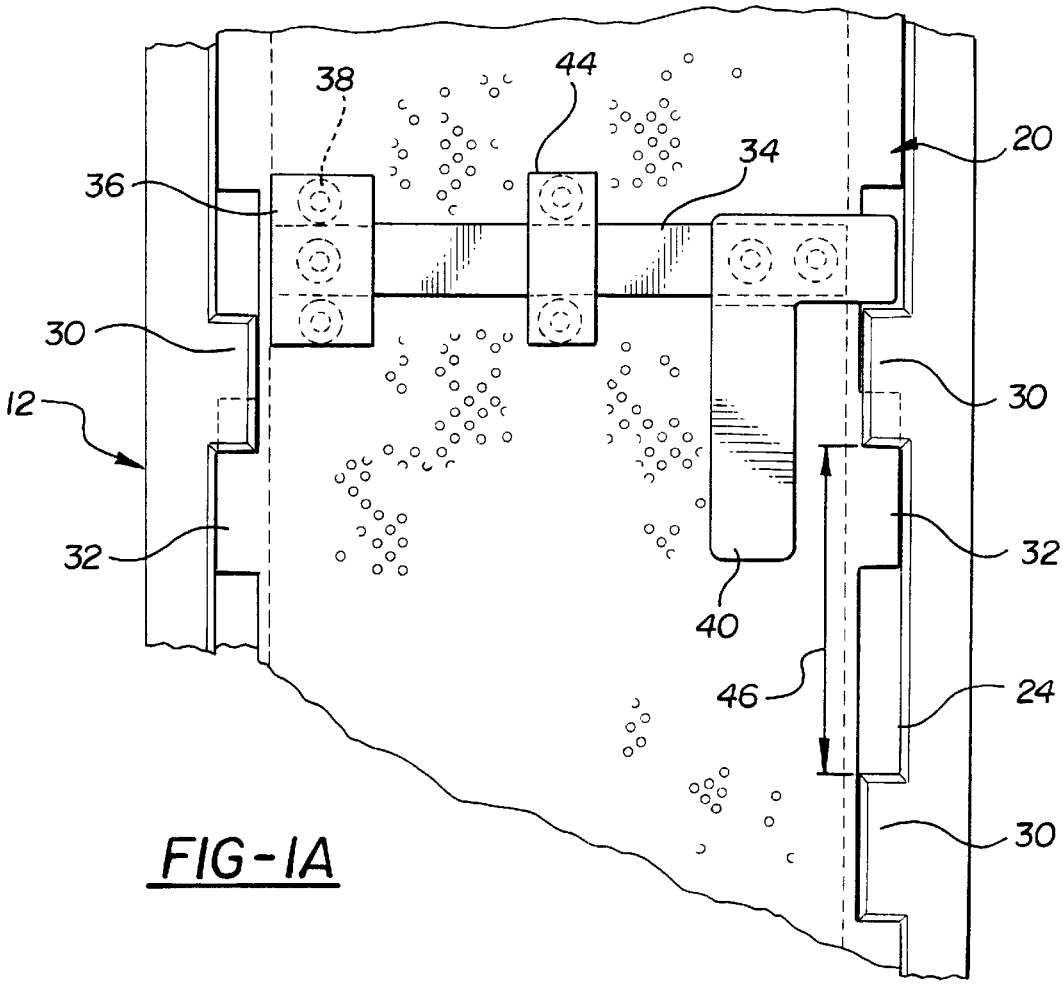
FIG-1A
FIG-2
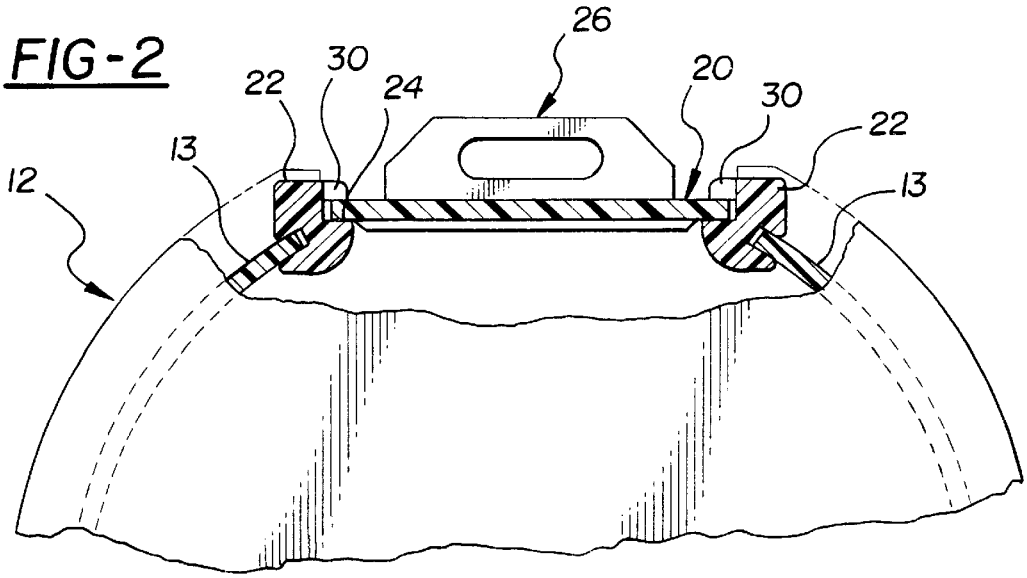

FIG-11
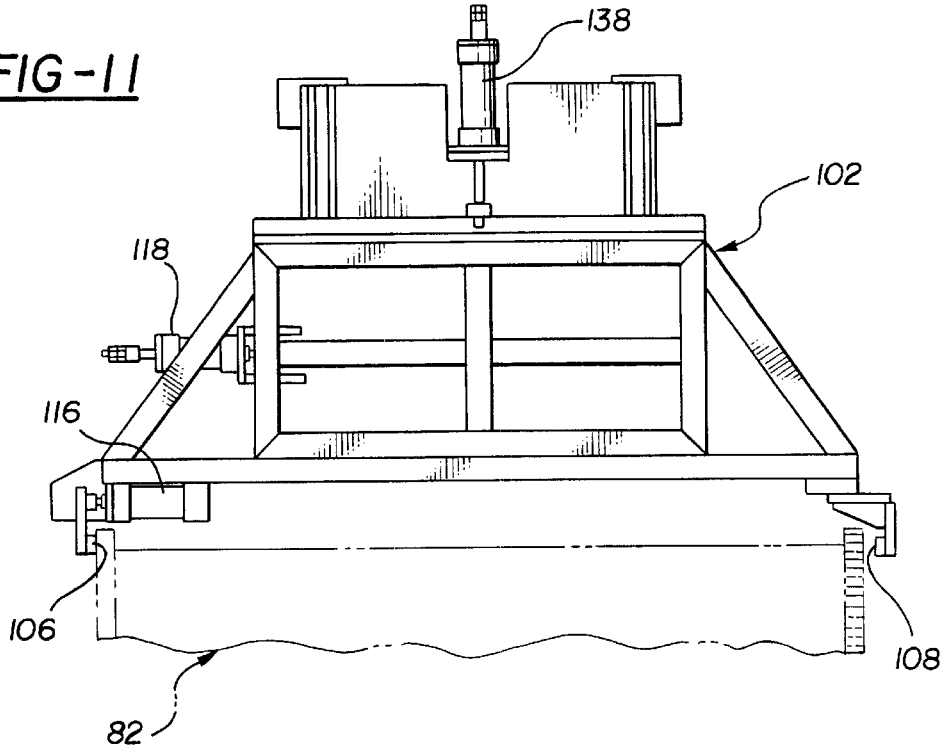
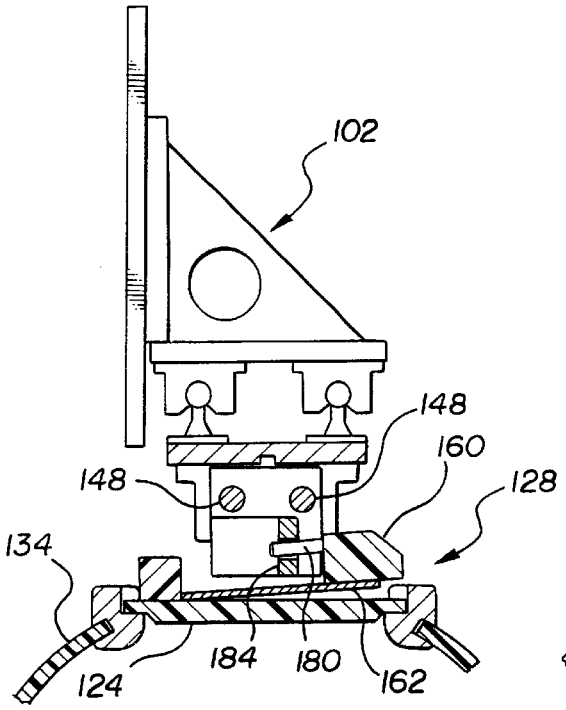
FIG-12
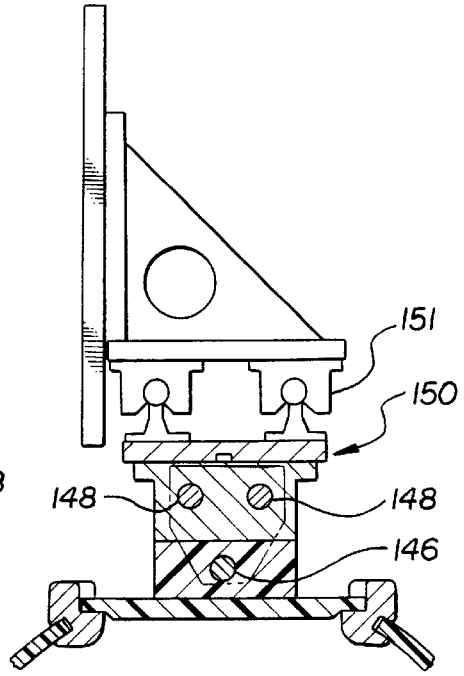
FIG-13

METAL FINISHING BARREL COVER LOCKING SYSTEM

CROSS REFERENCE TO RELATED APPLICATIONS

This application claims benefit of provisional Ser. No. 60/193,189, filed Mar. 30, 2000.

BACKGROUND OF THE INVENTION

This invention concerns metal finishing barrels used in the cleaning, plating, phosphating, etc. of metal parts in bulk.

A material which will not be attacked by the various processing solutions such as polypropylene or stainless steel is typically used to construct metal finishing barrels, which are perforated so as to allow the parts to be immersed when the barrel is lowered into a tank of a plating or other processing solution. The finishing barrel is rotatably mounted on a support structure to allow it to be rotated while immersed in the tank to tumble the parts insuring even processing, and a gear is affixed to one end of the barrel for driving the barrel with an electric motor.

One or more removable covers are installed over a loading/unloading opening provided in the side of the barrel. The covers must be closely fit to the opening to insure that small parts will not be captured in clearance cracks or escape through gaps between the cover and the barrel. The covers must also be held securely to withstand the heavy loads imposed by the weight of bulk quantities of metal parts as the finishing barrel is rotated.

These requirements have led to the development of an interlocking tab cover securement in which a series of tabs on each side of the cover are slid beneath barrel tabs projecting towards the barrel opening to secure the cover in position. A separate cover locking system is needed to positively prevent the cover from shifting back to release the tabs during processing. This locking system has previously taken the form of a polypropylene nut piece threaded into a gap between two covers arranged in end to end alignment over the opening, preventing the covers from shifting back to disengage the tabs.

This arrangement has worked very well, but requires the threading and unthreading of the separate nut piece, significantly slowing the process of installing and removing the covers manually. Further, this system makes it difficult to automate the cover installation and removal process, which automation is often desirable.

Accordingly, it is an object of the present invention to provide a processing barrel cover locking system which is positive and secure but does not require separately installed locking system components to speed up the installation and removal of the covers.

It is a further object to provide such a cover locking system which is readily compatible with an automated cover handling system.

SUMMARY OF THE INVENTION

The above recited objects of the invention, as well as other objects which will be understood upon a reading of the following specification and claims, are achieved by mounting a cover handle assembly including a spring blade attached at one end to the cover. The cover and barrel are each formed with a series of interfit tabs, which allow the cover to be placed into the barrel opening with the tabs offset. When the cover is slid in one direction, the cover tabs are positioned lying partially beneath the barrel tabs to be interengaged and hold the cover over the barrel opening.

The handle assembly is aligned between successive cover tabs to engage a barrel tab when the cover is pushed into place over the barrel opening, but the spring blade mounting allows the handle to be moved out to allow the cover to be advanced so that the cover tabs are positioned beneath the barrel tabs. The cover is then slid to a tab engaged position with the cover tabs partially lying beneath the barrel tabs to secure the cover in position over the barrel opening.

When the handle is released, the spring blade causes the handle assembly to move back down against the cover, with the handle assembly then located just to one side of the barrel tab. The handle assembly has a blocking portion which is then located to one side of that barrel tab, acting to block any reverse shifting of the cover back out from under the barrel tabs, to positively lock the cover in the secured position.

The handle assembly moves away from the cover when the handle is pulled as the cover is being removed against the force generated by the spring blade, to elevate the handle blocking portion above the barrel tab.

This outward movement of the handle assembly allows the cover to be slid back out from under the barrel tabs and then lifted off the barrel opening.

Either one or two covers can be employed, with one cover having a locking handle securing the other cover in position by an end to end abutment of the covers.

This cover locking system can be employed with an automated process of installing and removing the cover. In this application, the cover handle assembly comprises a rod cammed out by a cam on a slide, which also advances a series of rods into bores in respective upright pieces attached to the cover. The cover and rod slides are then advanced further in the same direction by another actuator and slide to move the tabs out of engagement and allow the cover to be lifted out by motion of a third slide and actuator.

DESCRIPTION OF THE DRAWINGS

FIG. 1A is an enlarged top view of a portion of the barrel assembly shown in FIG. 1.

FIG. 2 is a fragmentary end view of the finishing barrel assembly shown in FIG. 1.

FIG. 11 is a front view of the cover handling apparatus utilized for lengthwise location of the barrel assembly partially shown in phantom lines.

FIGS. 12 and 13 are fragmentary sectional views through the barrel assembly and the cover handling apparatus showing cover engagement, shown rotated out of its actual inclined position to a vertical position for clarity.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
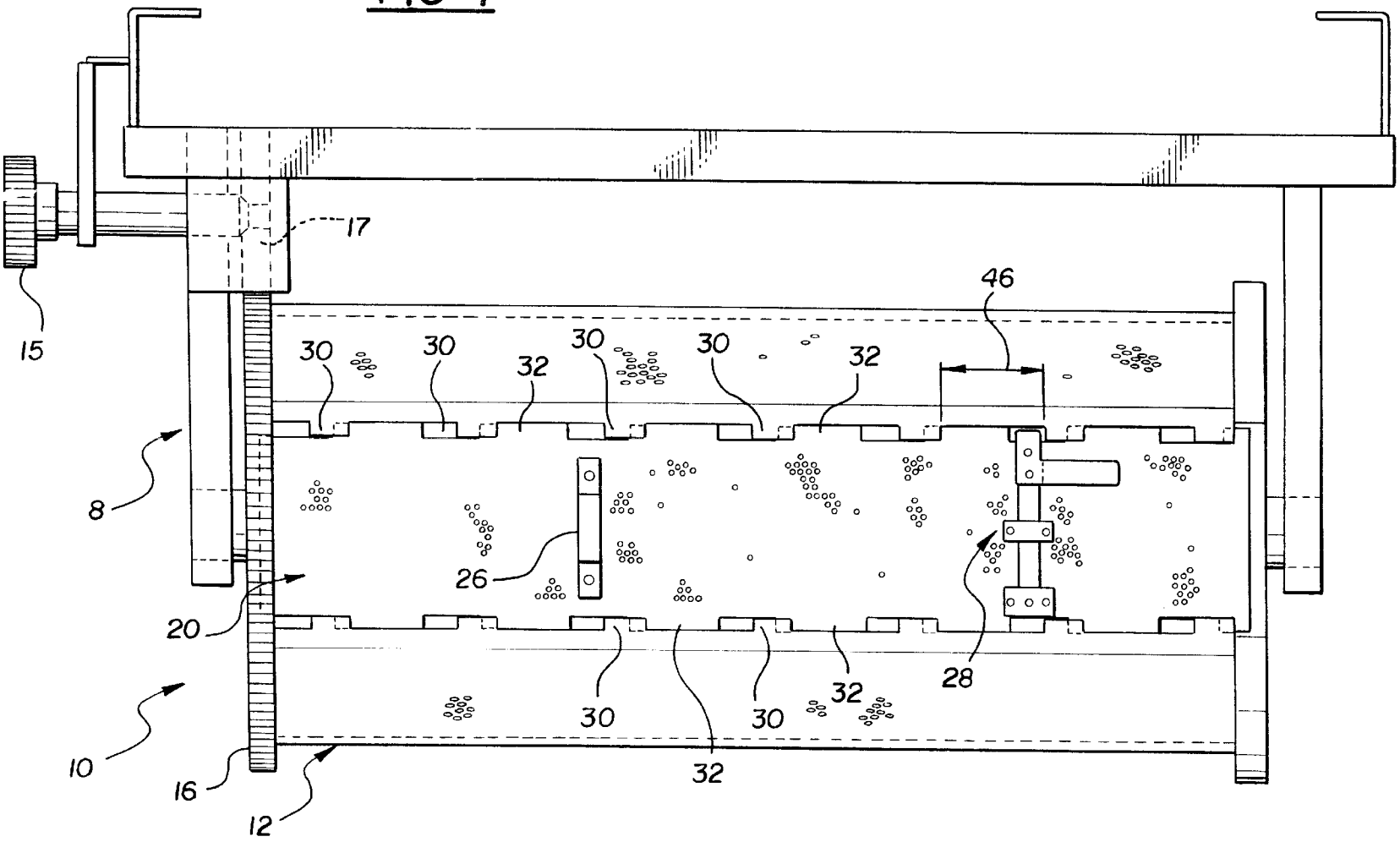
FIG. 1 is a top view of a metal finishing barrel assembly and support structure incorporating a cover lock system according to the invention.

Referring to the drawings and particularly FIG. 1, a metal finishing barrel assembly 10 is shown of a well known type, including a perforate barrel 12 rotatably supported on a support structure 8. A large polypropylene gear 16 is affixed to one end for rotating the barrel 12 while immersed in a solution in a processing tank (not shown) for uniform treatment of metal parts, using motor driving gears 15, 17 in the well known manner.

The barrel 12 has a lengthwise loading/unloading access side opening 18 (FIG. 2) formed therein of a generally rectangular shape. A perforate cover 20 is fit into the opening 18 and secured therein after the parts to be processed have been loaded. The opening 18 is defined by two rectangular frame pieces 22 having slots receiving the barrel wall 13. The barrel wall 13 shown is constructed of one half inch thick polypropylene plastic which has been stress relieved. Holes are drilled into the barrel wall 13 and cover 20 to allow the plating or other solutions to freely enter the barrel to reach the parts loaded therein.

A pair of handle assemblies 26, 28 are attached to the cover 20 for manually lifting the cover 20 into and out of the opening 18.

The handle assembly 28 incorporates features comprising part of a self acting cover locking system according to the invention, described below.

The frame 22 defines a ledge 24 on which the bottom of the cover 20 rests when placed over the opening 18. A series of spaced barrel tabs 30 are arrayed along the length of each side of the opening 18 projecting inwardly towards the opening 18. A corresponding series of spaced cover tabs 32 are arrayed along each side of the cover 20.

The tabs 30, 32 are configured so that in an offset position, the cover tabs 32 can pass between the barrel tabs 30 so as to position the cover tabs 32 below the barrel tabs 30, the cover 20 resting on the ledge 24.

When the cover 20 is shifted to the left as shown in FIG. 1, the cover tabs 32 move to a position lying partially beneath the barrel tabs 32, to secure the cover 20 over the opening 18. Thus, portions of the cover 20 and barrel 12 are interfit by a endwire sliding movement of the cover to secure the cover over the opening 18.

Figure 3:
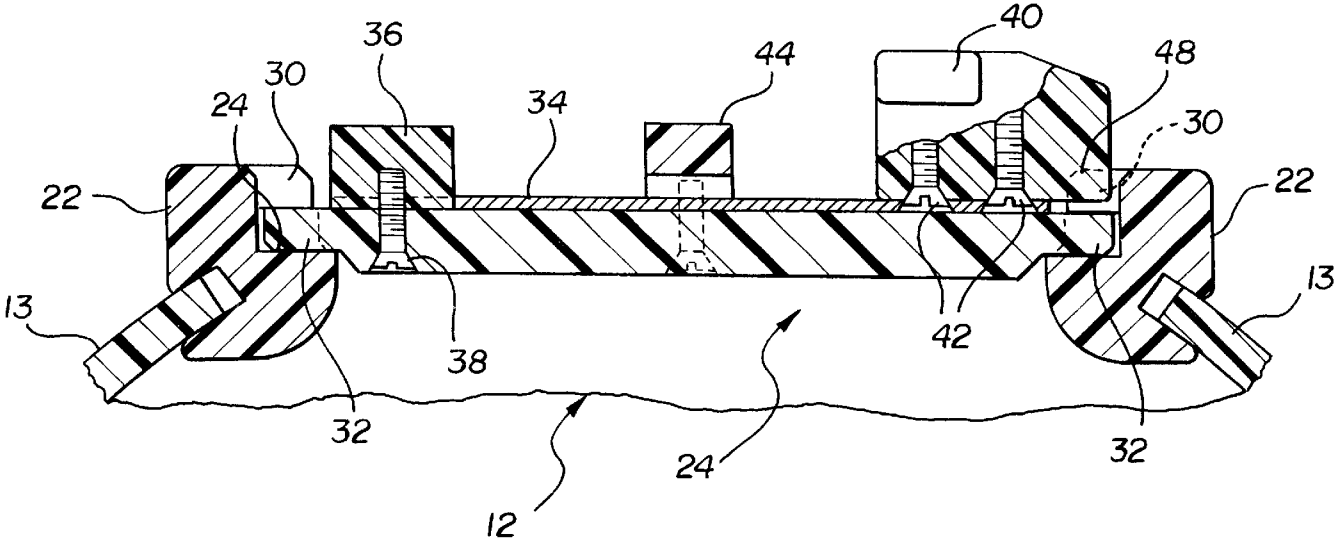
FIG. 3 is an enlarged fragmentary sectional view taken through the barrel and cover with the handle assembly shown in the locked condition.

The locking handle assembly 28 includes a spring blade 34 (FIGS. 1A, 3, 3A) fixed at one end to the cover 20 by a clamping block 36 and titanium screws 38. A handle piece 40 is attached to the free end of the spring blade as by titanium screws 42. A restraint piece 44 is secured to the cover 20 intermediate the length of the spring blade 34 limiting its upward movement and preventing any substantial sideways movement.

The cover 20 is lifted by grasping the handles 26 and 40 and placed over the opening 18 with the cover tabs 32 aligned with the gaps 46 between the barrel tabs 30.

Figure 3A:
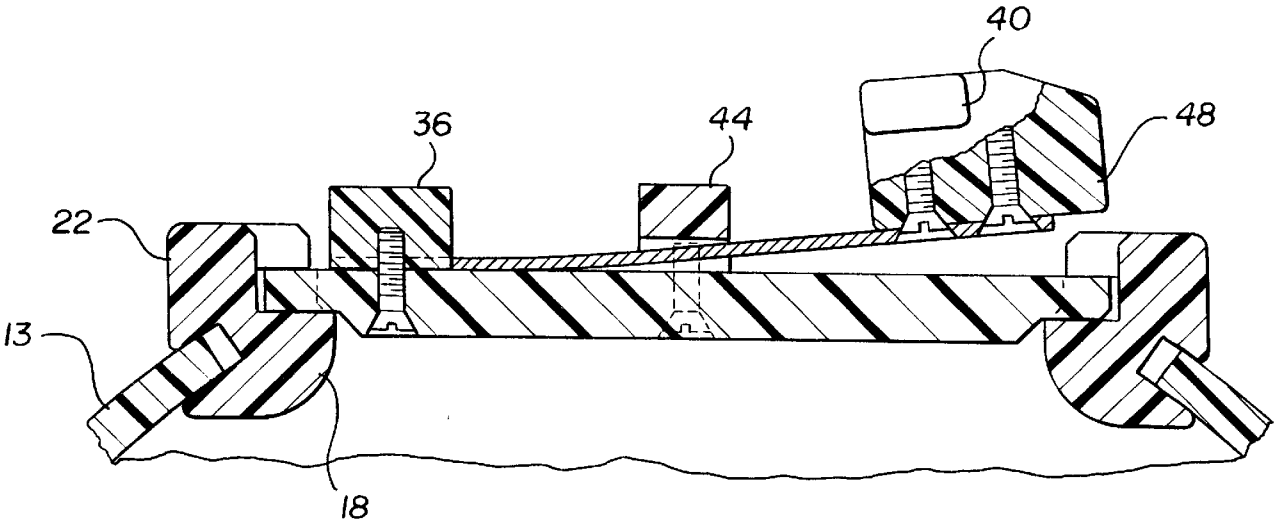
FIG. 3A is the same view as FIG. 3 but shows the handle assembly in the released position.

The cover 20 is pushed down into the opening 18. The locking handle piece 40 is aligned with a barrel tab 30 in this position, but is deflected away as the cover 20 is seated on the lip 24 to accommodate movement of the cover tabs 32 below the barrel tabs 30 (FIG. 3A).

Next, the cover 20 is slid to the left as seen in FIG. 1, until the left end abuts the gear end 16 of the barrel 12. In this position, the cover tabs 32 are partially overlain by the barrel tabs 30 to capture the cover 20 in the barrel opening 18. In this position, the handle piece nose 48 (FIGS. 3, 3A) lies aligned with a gap 46 (FIG. 1A) between two barrel tabs 30. Thus, when the handle 40 is released, the force of the deflected spring blade 34 pushes the nose portion 48 down to the left of the adjacent barrel tab 30. The barrel tab 30 thus acts as a locking element with respect to the nose portion 48, preventing the cover 20 from shifting to the right to unlock the cover tabs 32 from the position lying beneath the barrel tabs 30.

Accordingly, a positive locking action is achieved without any further action than that required to secure the cover 20 in place.

Figure 4:
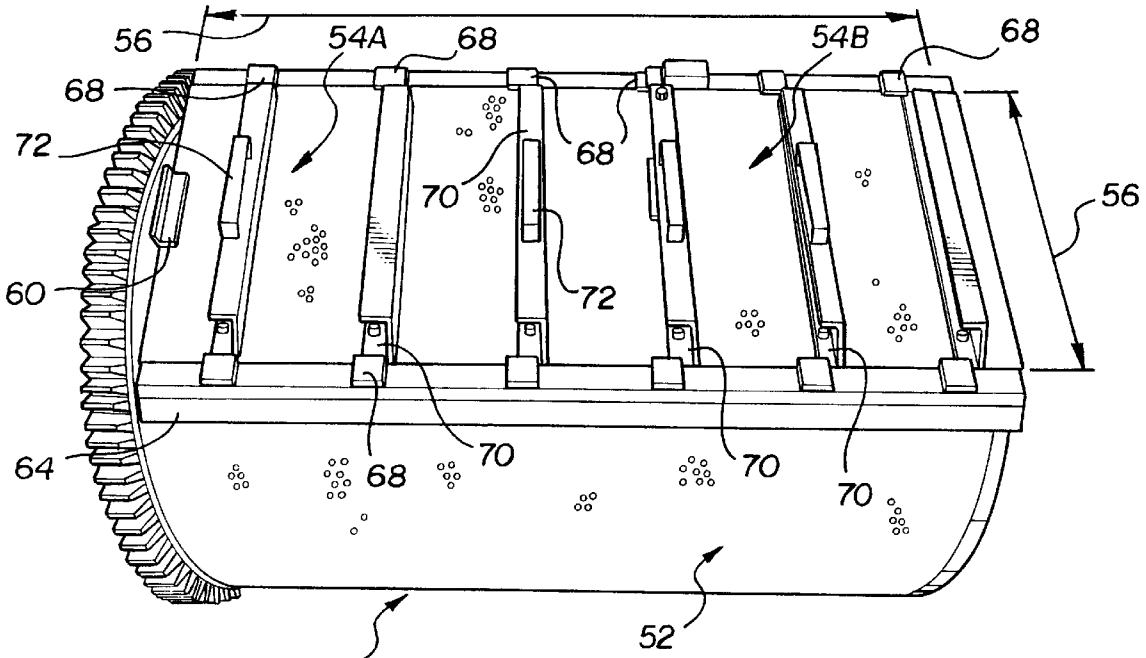
FIG. 4 is a perspective view of a second embodiment of the finishing barrel assembly including a cover locking system according to the invention.
Figure 5:
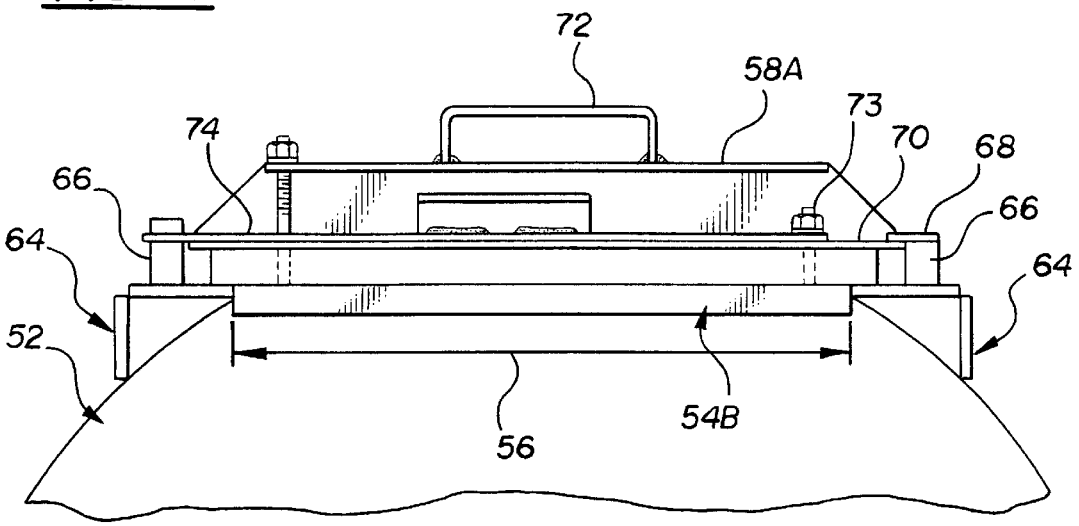
FIG. 5 is a fragmentary end view of the barrel assembly shown in FIG. 4.
Figure 6:
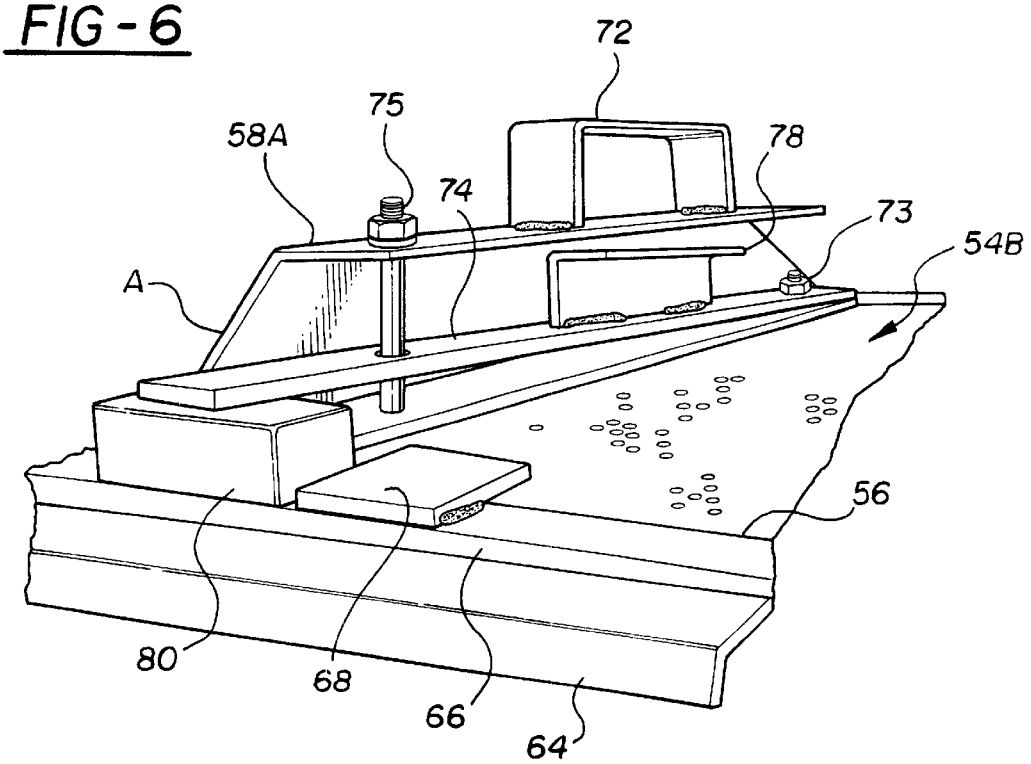
FIG. 6 is an enlarged perspective view of the locking handle assembly and portions of the cover and barrel shown in FIGS. 4 and 5.

Heavier duty metal finishing barrels are utilized in some processes, as in phosphating, and are typically constructed of metal such as stainless steel instead of plastic. FIGS. 4–6 show such a barrel assembly 50 including the barrel 52 and two covers 54A, 54B aligned end to end over a lengthwise opening 56 in the side of the barrel 52. The covers 54A, 54B shown are of polypropylene while the barrel 52 is made of stainless steel, but the covers 54A, 54B could be also made of stainless steel to minimize thermal growth and chemical expansion to avoid any tendency for wedging of the covers in place if higher temperature conditions are present.

Figure 4A:
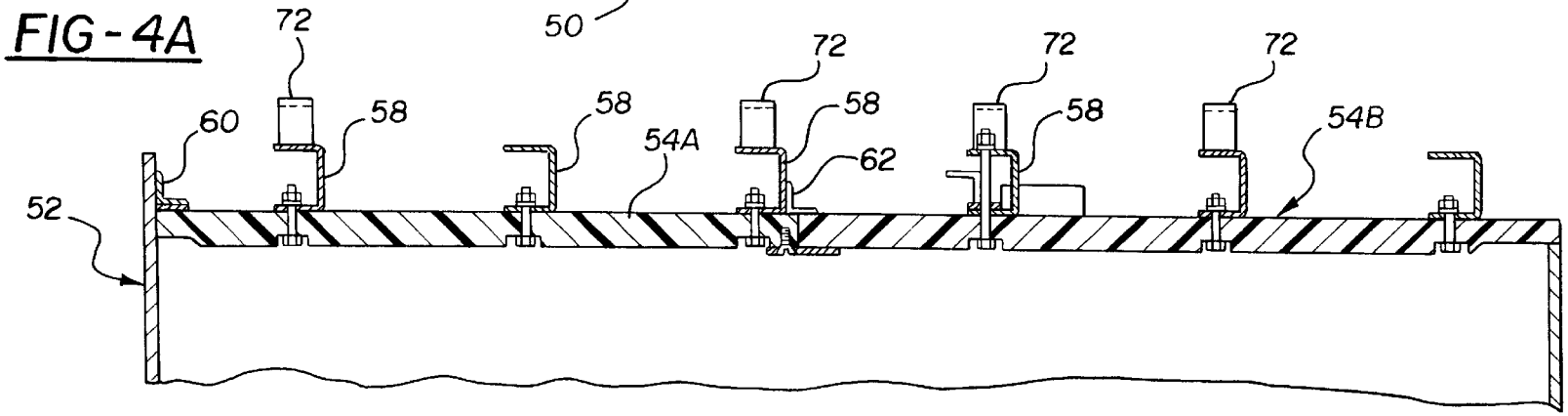
FIG. 4A is a fragmentary sectional view of the top portion of the barrel assembly shown in FIG. 4.

A series of metal channels 58 are attached to each cover 54A, 54B as shown in FIG. 4A. Angles 60, 62 insure a snug fit of the covers 54A, 54B.

A (stainless steel) frame 64 is welded to the barrel 52 defining the opening 56, with a spacer square bars 66 welded atop the frame 64 to support a series of barrel tabs 68 welded thereto.

Each end of each channel 58 is cut off at an angle A, and a bottom portion forms a cover tab 70 adapted to be slid below a corresponding barrel tab 68 as best seen in FIG. 4.

Each cover 54A, 54B has a pair of handles 72 welded to respective channels 58, enabling manual lifting of each of the covers 54A, 54B.

One of the channels 58A has a spring blade 74 mounted within it, anchored at one end by one of the attachment bolts 73 for the channel 58A itself (FIG. 6). The spring blade 74 extends within the channel 58A and projects beyond the opposite end. A bolt 76 passes through a hole in the spring blade 74 and the channel 58A, allowing up and down movement of the free end of the spring blade 74, but restraining, sideways movement. An angle 78 is welded to the top of the spring blade 74 and serves as a handle to lift the spring and limits the extent of up and down movement.

A stop block element 80 is welded next to a barrel tab 68, which element 80 is aligned with the projecting end of the spring blade 74 when the cover tabs 70 are aligned with the spaces to the right of the barrel tabs 68 when installing the cover 54B. The spring blade 74 deflects upwardly when the cover 54B is pushed down over the opening 56 as seen in FIG. 6.

Referring to FIGS. 7–16, a version of the cover lock system for use with an automated, power operated apparatus for removing and replacing the cover is shown, along with an embodiment of the automation apparatus.

Figure 7:
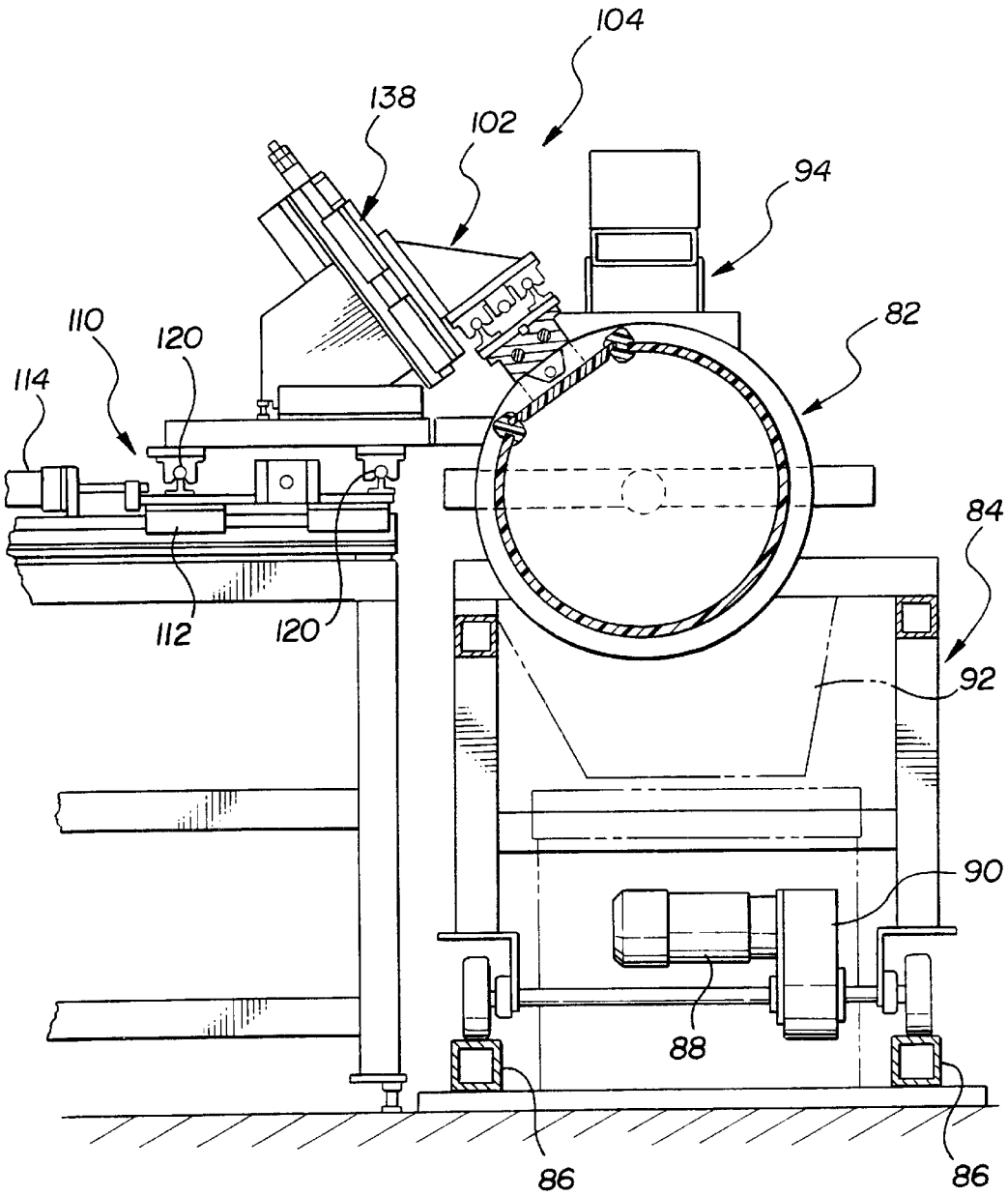
FIG. 7 is an end view of a finishing barrel assembly loaded in a transfer shuttle cart and positioned adjacent to an automated cover handling apparatus.
Figure 8:
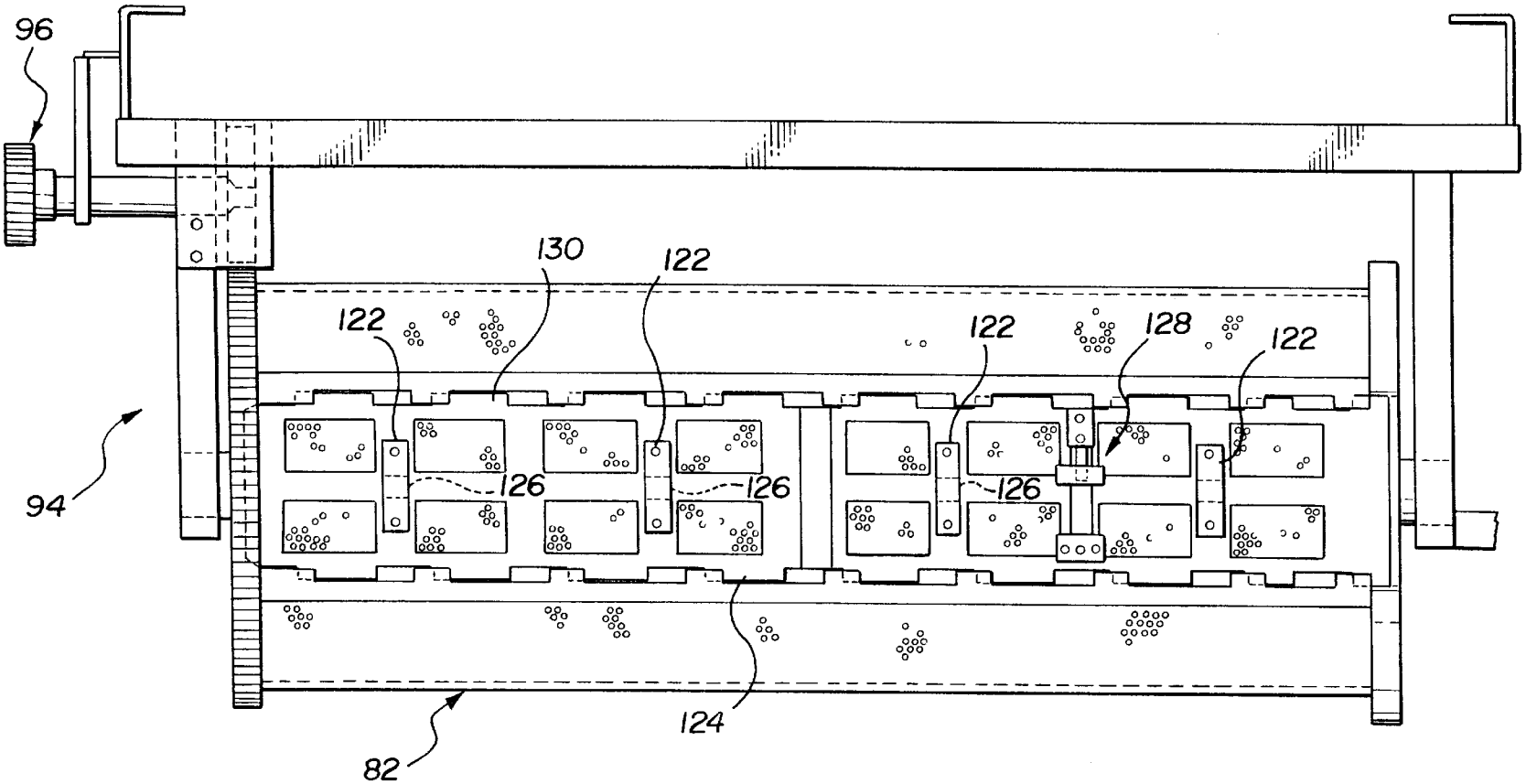
FIG. 8 is a front elevation view of the barrel assembly and a support structure therefor.

A metal finishing barrel assembly 82 is of the type described above is transported by a shuttle cart 84 between the processing system in which it is used and a cover removal-installation station (FIG. 7).

The barrel assembly 82 is rotatable on a support structure 94 (FIG. 8), driven by gearing 96 and a drive motor 98 (depicted diagrammatically) carried on the cart 84. The barrel assembly 82 is rotated thereby to a rough located position by use of a target and sensor (not shown), where the cover 124 is approximately located opposite a cover engagement slide 102 moveable upwardly at an angle, the angled slide 102 part of cover removal and installation apparatus 104.

The shuttle cart 84 is driven into the cover handling station with a pair of end locators 106, 108 (FIG. 11) spread apart prior to moving the engagement slide 102 and a platform 110 towards the barrel assembly 82 on slides 112 by an actuator 114 (FIG. 7).

The barrel assembly 82 is located endwise with respect to platform 110 which carries slide 102 by first moving the locator 106 toward the right against the left or idle end face of barrel assembly 82 by first actuator 116 as shown in FIG. 11. After said contact is made, further travel of locator 106 is prevented by the weight resistance of the barrel assembly 82, such that further travel of actuator 116 instead causes platform 110 which carries slide 102 and locator 108 to move toward the left on slides 120, forcing the second locator actuator 118 to retract (which is allowed by connecting the actuator 118 to drain), until locator 108 contacts the right or gear end face of the barrel assembly 82. At this point the barrel assembly 82 is located precisely in front of the cover handling apparatus 104, regardless of the initial non-precise positioning of the barrel assembly 82 by the shuttle cart 84 relative to the cover removal and installation apparatus 104.

The barrel assembly 82 is then rotated to a "fine" located position by operation of the motor 98, using a second target and sensor (not shown) to accomplish this.

In this version, a series of aligned upright pieces 122 (FIG. 8) are attached to the cover 124, each formed with a chamfered through bore 126. A single locking handle assembly 128 provided.

The cover 124 has a series of tabs 130 projecting outwardly along each side.

The barrel 134 has a series of tabs 132 projecting inwardly towards a rectangular loading access 136 opening in the barrel side defined by a frame 138 (FIGS. 12–16).

Figure 14:
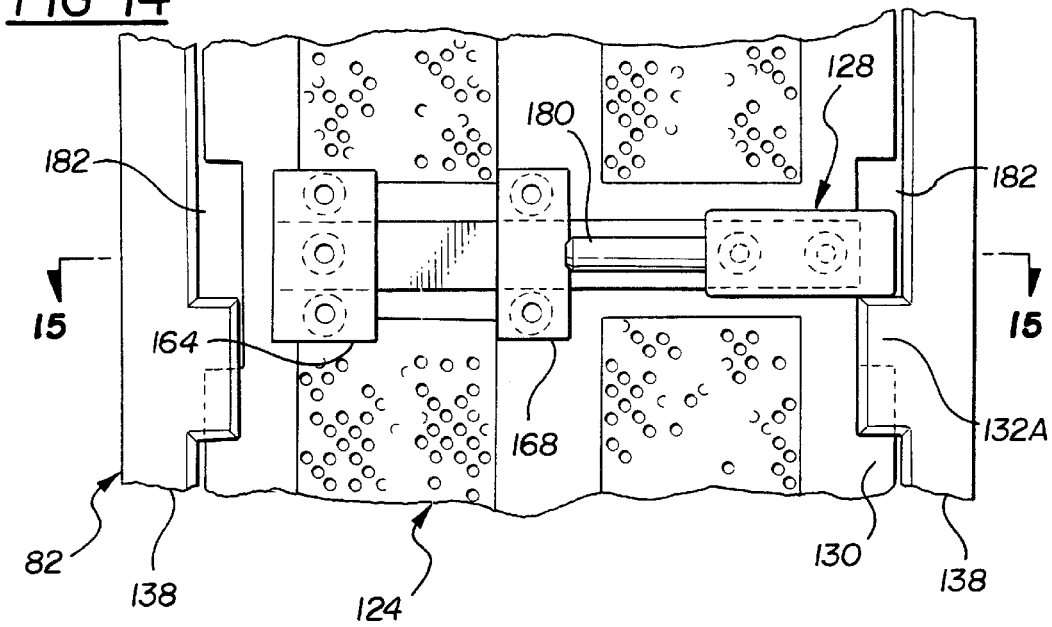
FIG. 14 is an enlarged plan view of a fragmentary portion of the barrel assembly showing the locking handle assembly.
Figure 15:
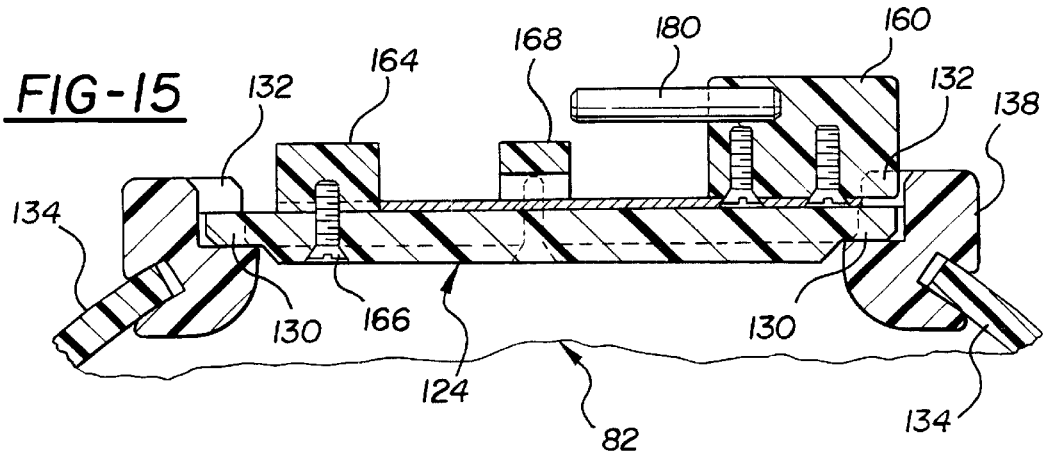
FIG. 15 is a view of the section 15—15 taken in FIG. 14.
Figure 16:
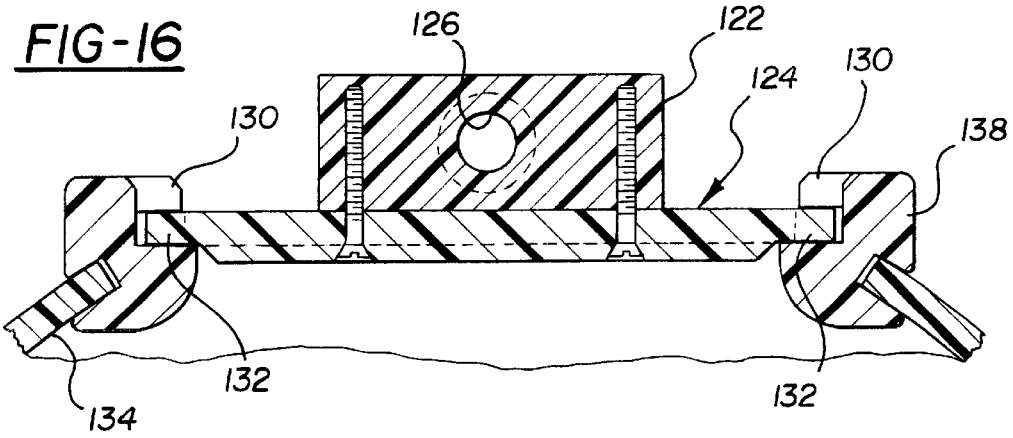
FIG. 16 is a sectional view taken through one of the rod engagement pieces attached to the barrel cover.

The cover 124 can be placed on the barrel opening 136 atop the frame 138 by aligning the cover tabs 130 with the spaces between the barrel tabs 132 as in the above described embodiments and then sliding the cover 124 endwise to carry the cover tabs 130 beneath the barrel tabs 132 (FIG. 14).

Both the installation and removal is done automatically in this apparatus.

Figure 9:
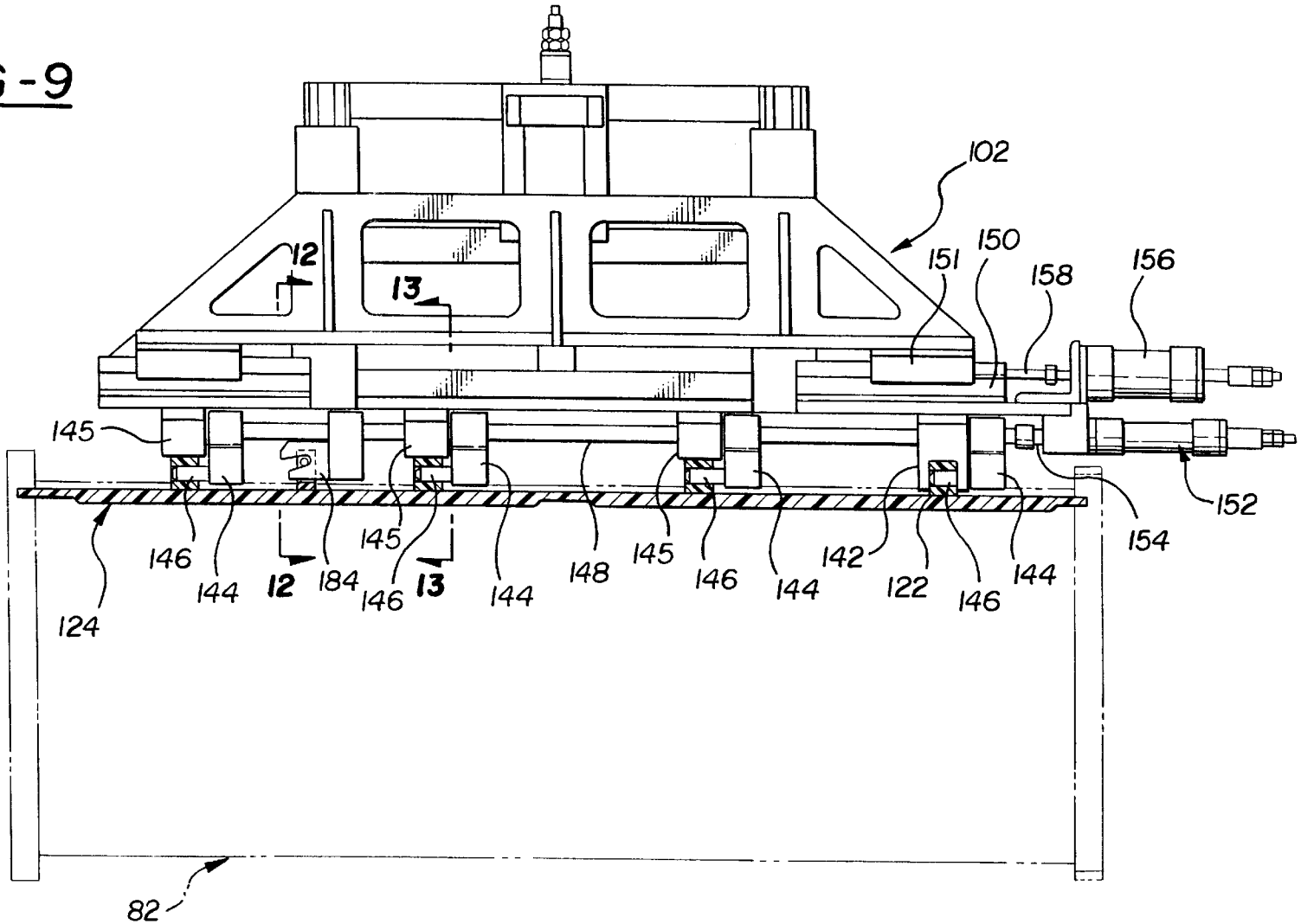
FIG. 9 is a front elevational view of the cover handling apparatus components for engaging the barrel cover, shown in section, portions of the barrel shown in phantom lines.
Figure 10:
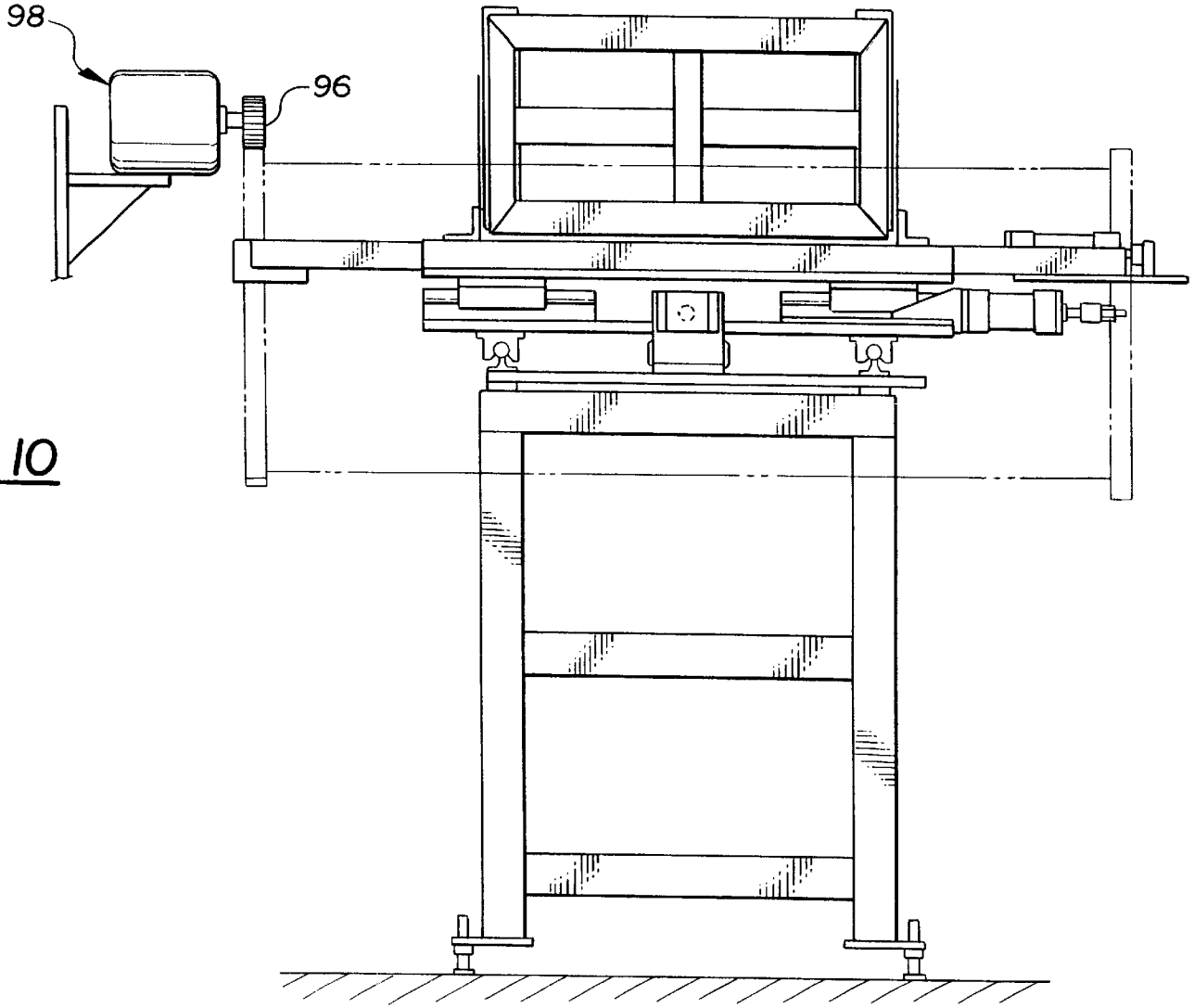
FIG. 10 is a front elevational view of the barrel assembly positioned in front of the cover handling apparatus diagrammatically depicting a shuttle mounted motor for rotating the barrel assembly to a predetermined located rotary position.

With the cover 124 in a locked position on the barrel 134, and with the barrel assembly 82 precisely located endwise and rotationally, an actuator 138 is activated to carry the cover engagement angle slide 102 down onto the cover 124 (FIGS. 9, 11). In this position, a fork piece 142 (FIG. 9) captures one of the upright pieces 122, while rod carriers 144 are located to the right of each upright piece 122, respective rods 146 each being aligned with a respective chamfered bore 126. The rod carriers 144 are all supported on a pair of lengthwise extending rods 148, which are in turn supported on a lengthwise slide 150 supported on guides 151.

A first lengthwise actuator 152 fixed to slide 150 has a movable output rod 154 which drives all of the rod carriers 144 to the left against stops 145 and fork piece 142 (FIG. 9), seating the rods 146 in their respective aligned bores 126 in the upright pieces 122.

A second lengthwise actuator 156 is connected to the slide 150, with an output rod 158 connected to the structure 102.

The handle assembly 128 (FIGS. 14–16) includes a rod holder 160 fastened to a free end of a spring blade 162 with titanium screws 164. The spring blade 162 is fastened to the cover 124 at its opposite end with a clamping piece 164 by titanium screws 166. A side to side and outward restriction on the movement of the spring blade 162 is provided by a U-shaped piece 168 fastened to the cover 124 with titanium screws 170 at a point intermediate the length of the spring blade 162. An opening 172 is sized to prevent side to side movement while allowing a predetermined extent of outward deflection of the free end of the spring blade 162.

A cam rod 180 extends back over the cover 124 from one side of the rod holder 160 (cam rod 180 may also be grasped as a manual handle).

The cover tabs 130 are sized to fit between spaces 182 between the barrel tabs 132 when the cover 124 is positioned to align the same at the beginning of the cover removal cycle.

The rod holder 160 is urged down by the spring blade 162 to normally occupy one of the barrel tab spaces 182, which thus engages an adjacent barrel tab 132A, preventing the cover 124 from shifting back to allow the cover tabs 130 to move out from under the barrel tabs 132.

When the actuator 152 moves the rods 148 to the left, a cam piece 184 mounted thereon (FIG. 9) is also driven to the left to engage the cam rod 180, forcing the cam rod 180 to move out as seen in FIG. 12, moving the rod holder 160 away to clear the adjacent barrel tab 132.

When activated, the actuator 156 causes the slide 150 to move to the left to carry the rods 148, cover 124, and rod carriers 144 to the left, sliding the cover tabs 130 out from under the barrel tabs 132.

The locator actuators 116, 118 are operated to spread the locators 106, 108 out of engagement with the barrel 134.

The actuator 138 is then operated to move the cover 124 off and away from the barrel 134, actuator 114 retracting all of these parts and the cover 124 back.

The barrel 134 is then unloaded and then reloaded with parts, and the cover 124 replaced by the reverse of the cycle described.

In placing the cover 124 onto the barrel 134, the handle rod holder 160 engages a barrel tab 132A and the spring blade 162 deflects to allow the rod holder 160 to move out as the cover 124 is advanced over the barrel opening 136. As the cover 124 is slid lengthwise, the rod holder 160 is moved back in by the spring blade 162 to be positioned adjacent a barrel tab 132A to lock the cover 124 in the secured position.

What is claimed is:

1. A perforated finishing barrel assembly including a finishing barrel having a lengthwise extending access opening in one side thereof, and at least one cover fit into said opening, said barrel side having a lengthwise series of tabs formed along said opening and projecting towards said opening, said cover having a series of spaced apart outwardly projecting tabs formed along its length, said respective series of tabs configured to allow said cover tabs to be pushed between said barrel tabs in a lengthwise relative position of said cover over said opening, said cover tabs thereby positioned past said barrel tabs and against said barrel, said cover able to be shifted lengthwise to cause capturing of said cover tabs beneath said barrel tabs to secure said cover on said barrel, the improvement comprising:

at least one locking handle assembly secured to said cover enabling positioning of said cover on said barrel overlying said opening therein and lifting of said cover from said barrel opening, said locking assembly including a graspable handle mounted on said cover by a spring blade affixed at one end to said cover and free at the other end which mounts said handle to be deflectable away from said cover to a limited extent, a locking feature fixed to said barrel side positioned opposite said handle when said cover series of tabs are aligned with spaces between said barrel spaces in said lengthwise relative position, said deflectability of said spring blade causing said locking feature to push allowing said cover to be slid to move said cover tabs past said barrel tabs with said handle on said locking feature, said locking feature configured so that said handle moves past said locking feature upon shifting of said cover so as to bring said cover tabs beneath said barrel tabs, whereat a side of said locking feature blocks a portion of said handle assembly to positively prevent shifting endwise movement of said cover in the opposite direction, whereby said cover is locked in position over said barrel side opening.

2. The barrel finishing assembly according to claim 1 wherein said cover abuts against a surface on said barrel upon shifting to said tab locking position to prevent continued lengthwise movement.

3. The barrel finishing assembly according to claim 1 wherein one of said series of barrel tabs acts as said locking feature engaging said locking handle assembly.

4. The barrel finishing assembly according to claim 1 further including a restraining feature limiting the extent of sideward movement of said spring blade.

5. The barrel finishing assembly according to claim 1 wherein another cover also overlies said barrel side opening in endwise abutment with said cover having said handle assembly attached, said another cover locked in position by locking of said first mentioned cover.

6. The barrel finishing assembly according to claim 1 wherein said locking feature comprises a block separate from said barrel tabs affixed to said barrel side adjacent said opening.

7. The barrel finishing assembly according to claim 1 wherein said finishing barrel and cover are constructed of perforated polypropylene.

8. The barrel finishing assembly according to claim 1 wherein said cover and barrel of constructed are stainless steel, said cover being substantially flat.

9. The barrel finishing assembly according to claim 4 wherein said restraining feature also limits outward movement of said spring blade.

* * * * *